US012377461B2

(12) United States Patent
Lee

(10) Patent No.: US 12,377,461 B2
(45) Date of Patent: Aug. 5, 2025

(54) METAL POWDER

(71) Applicant: TOKUSEN KOGYO CO., LTD., Ono (JP)

(72) Inventor: Woojin Lee, Ono (JP)

(73) Assignee: TOKUSEN KOGYO CO., LTD., Ono (JP)

( * ) Notice: Subject to any disclaimer, the term of this patent is extended or adjusted under 35 U.S.C. 154(b) by 327 days.

(21) Appl. No.: 18/021,990

(22) PCT Filed: Aug. 4, 2021

(86) PCT No.: PCT/JP2021/028883
§ 371 (c)(1),
(2) Date: Feb. 17, 2023

(87) PCT Pub. No.: WO2022/079983
PCT Pub. Date: Apr. 21, 2022

(65) Prior Publication Data

US 2023/0241671 A1 Aug. 3, 2023

(30) Foreign Application Priority Data

Oct. 15, 2020 (JP) ..... 2020-173712

(51) Int. Cl.
*B22F 1/05* (2022.01)

(52) U.S. Cl.
CPC ..... *B22F 1/05* (2022.01); *B22F 2301/255* (2013.01); *B22F 2304/10* (2013.01)

(58) Field of Classification Search
None
See application file for complete search history.

(56) References Cited

U.S. PATENT DOCUMENTS

2006/0137488 A1* 6/2006 Sakaue ..... B22F 1/068 75/255
2007/0209475 A1* 9/2007 Sakaue ..... H01B 1/22 75/255
2017/0326639 A1 11/2017 Lee et al.

FOREIGN PATENT DOCUMENTS

JP 2007-254845 A 10/2007
JP 2016138300 A * 8/2016 ..... B22F 1/00
JP 2016139598 A * 8/2016 ..... B22F 1/00
(Continued)

OTHER PUBLICATIONS

Dandapat—distinct hierarchical Ag structures—RSC Adv.—PCT D3—Euro D1—2015 (Year: 2015).*
(Continued)

*Primary Examiner* — John Vincent Lawler
(74) *Attorney, Agent, or Firm* — Sughrue Mion, PLLC

(57) ABSTRACT

A metal powder is an ensemble of fine metal particles. The fine metal particles include fine layered metal particles (2). Each of the fine layered metal particles (2) includes a center layer (4), an upper middle layer (6), an upper end layer (8), a lower middle layer (10), and a lower end layer (12). Each of the layers is a flake. The flakes belong to the same crystal. There is a space S1 between the center layer (4) and the upper middle layer (6). There is a space S2 between the upper middle layer (6) and the upper end layer (8). There is a space S3 between the center layer (4) and the lower middle layer (10). There is a space S4 between the lower middle layer (10) and the lower end layer (12).

13 Claims, 8 Drawing Sheets

(56) References Cited

FOREIGN PATENT DOCUMENTS

WO 2016/125355 A1 8/2016

OTHER PUBLICATIONS

Okada—JP 2016-138300 A—PCT D1—Euro D2-MT—copper powder—2016 (Year: 2016).*
Okada—JP 2016-139598 A—PCT D2-MT—silver powder—2016 (Year: 2016).*
ThoughtCo—Table of Electrical Resistivity and Conductivity—Mar. 5, 2025 (Year: 2025).*
Anirban Dandapat et al., "Single-step synthesis of various distinct hierarchical Ag structures", RSC Advances, Sep. 29, 2015, pp. 84257-84262, vol. 5.
International Search Report for PCT/JP2021/028883 dated Sep. 28, 2021.

* cited by examiner

METAL POWDER

This Application is a National Stage of International Application No. PCT/JP2021/028883 filed Aug. 4, 2021, claiming priority based on Japanese Patent Application No. 2020-173712 filed Oct. 15, 2020.

TECHNICAL FIELD

The present invention relates to metal powders. Particularly, the present invention relates to a metal powder suitable for purposes that require electrical conductivity.

BACKGROUND ART

An electrically-conductive paste is used to produce a printed circuit board of an electronic device. The paste contains a metal powder, a binder, and a solvent. The metal powder is an ensemble of fine metal particles. Processes such as printing and etching using the paste result in a pattern by which one element is coupled to another element. The pattern is heated. The heating leads to sintering of the fine metal particles adjacent to one another. The pattern is a path for electrons and thus needs to have high electrical conductivity.

Japanese Laid-Open Patent Application Publication No. 2007-254845 discloses particles made of silver and shaped as flakes. The particles are formed by processing spherical particles using a ball mill. The particles overlap one another in a pattern. This overlapping can contribute to the electrical conductivity of the pattern.

WO 2016/125355 discloses particles made of silver and shaped as flakes. The particles are obtained by precipitation from a liquid in which silver oxalate is dispersed. The particles overlap one another in a pattern. This overlapping can contribute to the electrical conductivity of the pattern.

CITATION LIST

Patent Literature

PTL 1: Japanese Laid-Open Patent Application Publication No. 2007-254845
PTL 2: WO 2016/125355

SUMMARY OF INVENTION

Technical Problem

The patterns obtained from the conventional flaky particles are unsatisfactory in the through-thickness electrical conductivity. An object of the present invention is to provide a metal powder by the use of which a pattern having high electrical conductivity can be obtained.

Solution to Problem

A fine layered metal particle according to the present invention includes:

a first layer shaped as a flake; and a second layer shaped as a flake, located on the first layer, and integral with the first layer.

Preferably, the second layer is partially spaced from the first layer.

Preferably, a material of the fine layered metal particle is an electrically-conductive metal. A preferred electrically-conductive metal is silver or copper.

In another aspect, a metal powder according to the present invention includes fine metal particles. The fine metal particles include fine layered metal particles. Each of the fine layered metal particles includes:

a first layer shaped as a flake; and a second layer shaped as a flake, located on the first layer, and integral with the first layer.

Preferably, a proportion of the fine layered metal particles in the fine metal particles is 30 mass % or more.

Preferably, an average particle diameter of the metal powder is from 0.1 to 30 μm. Preferably, a standard deviation of particle diameters of the metal powder is 15 μm or less.

Advantageous Effects of Invention

In a pattern obtained from the metal powder according to the present invention, the adjacent metal particles overlap one another. This overlapping contributes to the electrical conductivity of the pattern in the length direction. In each of the metal particles, the electrical resistance between the first layer and the second layer is very low since the second layer is integral with the first layer. The metal particles contribute to the electrical conductivity of the pattern in the thickness direction. The pattern has excellent electrical conductivity.

DESCRIPTION OF EMBODIMENTS

The following will describe the present invention in detail based on preferred embodiments with appropriate reference to the drawings.

Figure 1:
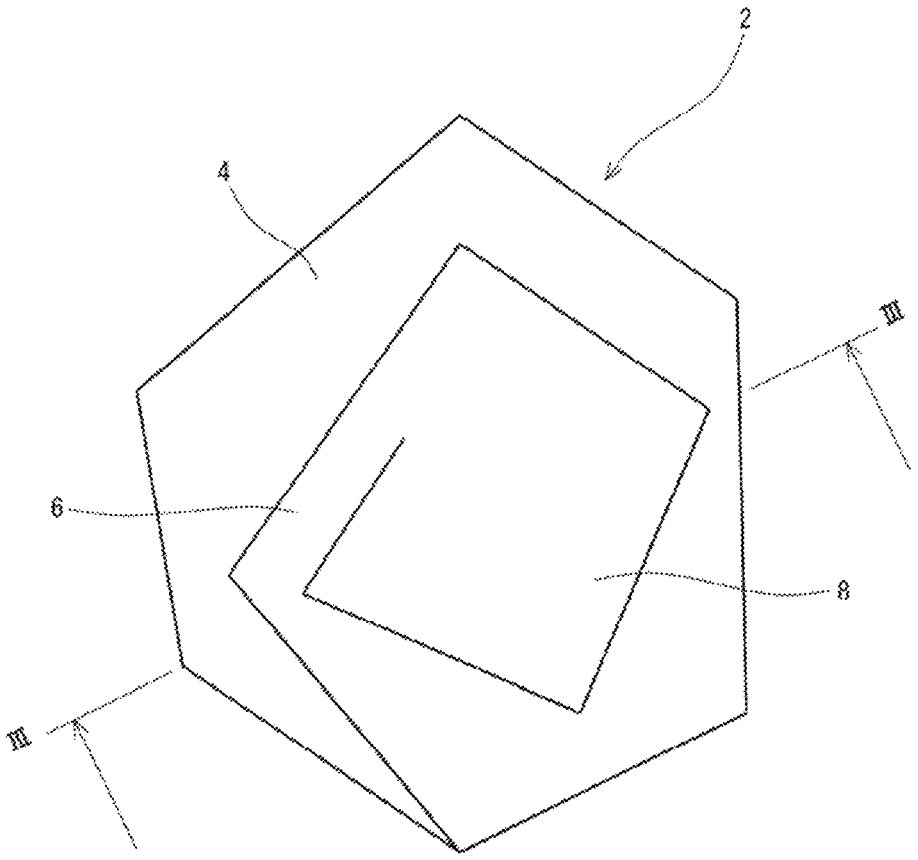
FIG. 1 is a plan view showing a fine layered metal particle according to one embodiment of the present invention.
Figure 2:
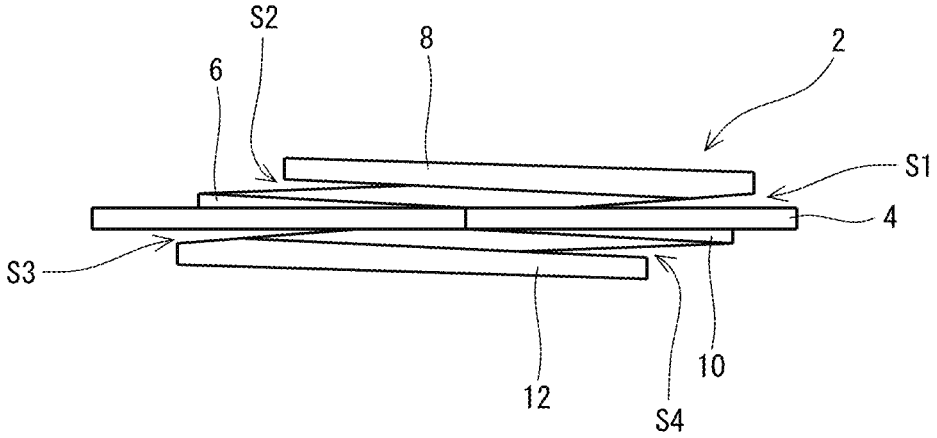
FIG. 2 is a front view showing the fine layered metal particle of FIG. 1.
Figure 3:
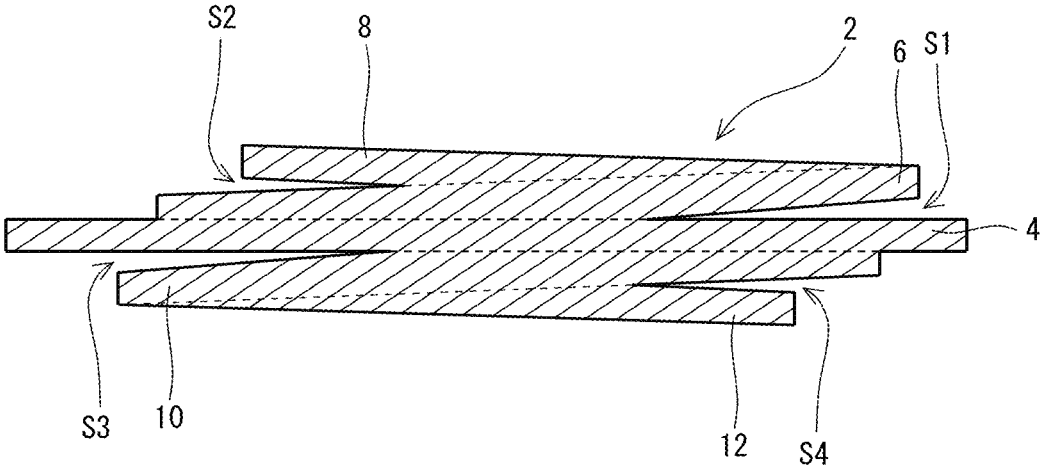
FIG. 3 is an enlarged cross-sectional view taken along the line III-III of FIG. 1.

A metal powder according to the present invention is an ensemble of fine metal particles. The fine metal particles include fine layered metal particles. FIGS. 1 to 3 show one fine layered metal particle 2. The main component of the fine layered metal particle 2 is an electrically-conductive metal.

The metal powder is typically used in an electrically-conductive paste. The electrically-conductive paste can be obtained by mixing the metal powder, a solvent, a binder, a dispersant, etc.

As shown in FIGS. 1 to 3, the fine layered metal particle 2 includes a center layer 4, an upper middle layer 6, an upper end layer 8, a lower middle layer 10, and a lower end layer 12.

The center layer 4 is shaped as a flake. In other words, the center layer 4 is in the shape of a thin sheet. The outline of the center layer 4 as viewed in plan is polygonal (typically triangular or hexagonal). The center layer 4 is a crystal of an electrically-conductive metal. Preferably, the center layer 4 is a crystal of silver or copper.

The upper middle layer 6 is shaped as a flake. In other words, the upper middle layer 6 is in the shape of a thin sheet. The upper middle layer 6 is a crystal of an electrically-conductive metal. Preferably, the upper middle layer 6 is a crystal of silver or copper. The upper middle layer 6 is located on the center layer 4. The upper middle layer 6 is integral with the center layer 4. The middle layer 6 belongs to the same crystal as the center layer 4. In the present invention, when two layers belong to the same crystal, these layers are considered integral. Two layers integral with each other need not belong to the same crystal grain. In other words, each of the layers may be a polycrystal. As the upper middle layer 6 is integral with the center layer 4, the electrical resistance between the center layer 4 and the upper middle layer 6 is very low.

As described later, the center layer 4 and the upper middle layer 6 are formed by crystal growth. Thus, in a real fine layered metal particle 2, the center layer 4 and the upper middle layer 6 are not clearly distinguishable. In the front view of FIG. 2, the two layers are apparently distinguishable.

As is clear from FIG. 3, there is a space S1 between the center layer 4 and the upper middle layer 6. In other words, the upper middle layer 6 is partially spaced from the center layer 4.

The upper end layer 8 is shaped as a flake. In other words, the upper end layer 8 is in the shape of a thin sheet. The upper end layer 8 is a crystal of an electrically-conductive metal. Preferably, the upper end layer 8 is a crystal of silver or copper. The upper end layer 8 is located on the upper middle layer 6. The upper end layer 8 is integral with the upper middle layer 6. The upper end layer 8 belongs to the same crystal as the upper middle layer 6. Thus, the electrical resistance between the upper middle layer 6 and the upper end layer 8 is very low.

As described later, the upper middle layer 6 and the upper end layer 8 are formed by crystal growth. Thus, in a fine layered metal particle 2, the upper middle layer 6 and the upper end layer 8 are not clearly distinguishable. In the front view of FIG. 2, the two layers are apparently distinguishable.

As is clear from FIG. 3, there is a space S2 between the upper middle layer 6 and the upper end layer 8. In other words, the upper end layer 8 is partially spaced from the upper middle layer 6.

The lower middle layer 10 is shaped as a flake. In other words, the lower middle layer 10 is in the shape of a thin sheet. The lower middle layer 10 is a crystal of an electrically-conductive metal. Preferably, the lower middle layer 10 is a crystal of silver or copper. The lower middle layer 10 is located under the center layer 4. The lower middle layer 10 is integral with the center layer 4. The lower middle layer 10 belongs to the same crystal as the center layer 4. Thus, the electrical resistance between the center layer 4 and the lower middle layer 10 is very low.

As described later, the center layer 4 and the lower middle layer 10 are formed by crystal growth. Thus, in a real fine layered metal particle 2, the center layer 4 and the lower middle layer 10 are not clearly distinguishable. In the front view of FIG. 2, the two layers are apparently distinguishable.

As is clear from FIG. 3, there is a space S3 between the center layer 4 and the lower middle layer 10. In other words, the lower middle layer 10 is partially spaced from the center layer 4.

The lower end layer 12 is shaped as a flake. In other words, the lower end layer 12 is in the shape of a thin sheet. The lower end layer 12 is a crystal of an electrically-conductive metal. Preferably, the lower end layer 12 is a crystal of silver or copper. The lower end layer 12 is located under the lower middle layer 10. The lower end layer 12 is integral with the lower middle layer 10. The lower end layer 12 belongs to the same crystal as the lower middle layer 10. Thus, the electrical resistance between the lower middle layer 10 and the lower end layer 12 is very low.

As described later, the lower middle layer 10 and the lower end layer 12 are formed by crystal growth. Thus, in a real fine layered metal particle 2, the lower end layer 12 and the lower middle layer 10 are not clearly distinguishable. In the front view of FIG. 2, the two layers are apparently distinguishable.

As is clear from FIG. 3, there is a space S4 between the lower middle layer 10 and the lower end layer 12. In other words, the lower end layer 12 is partially spaced from the lower middle layer 10.

In the fine layered metal particle 2, the center layer 4, the upper middle layer 6, the upper end layer 8, the lower middle layer 10, and the lower end layer 12 belong to the same crystal.

Figure 4:
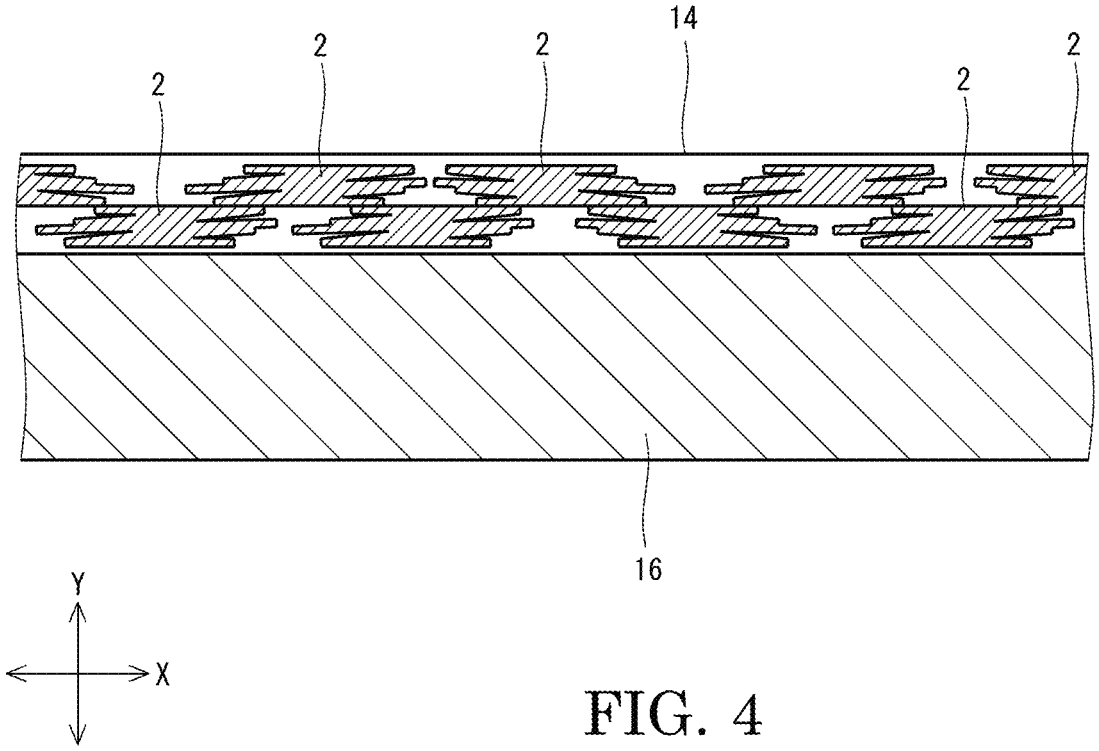
FIG. 4 is a schematic cross-sectional view of a pattern obtained from an electrically-conductive paste containing the fine layered metal particles as shown in FIGS. 1 to 3 and shows the pattern together with a base.
Figure 5:
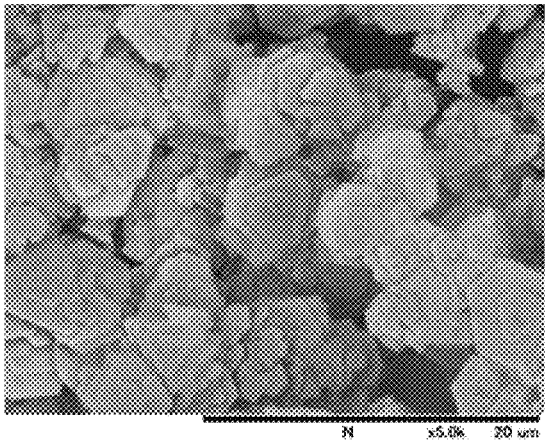
FIG. 5 is a micrograph showing a metal powder containing the fine layered metal particles as shown in FIG. 1.
Figure 6A:
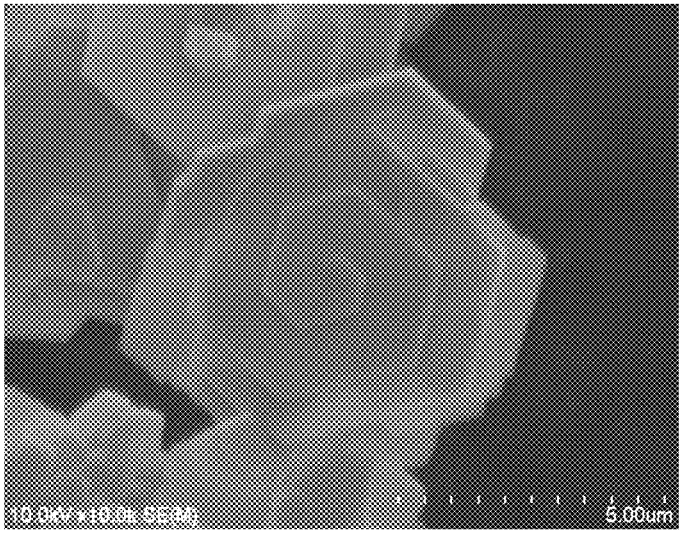
FIGS. 6A to 6C are micrographs showing a metal powder containing the fine layered metal particles as shown in FIG. 1.
Figure 6B:
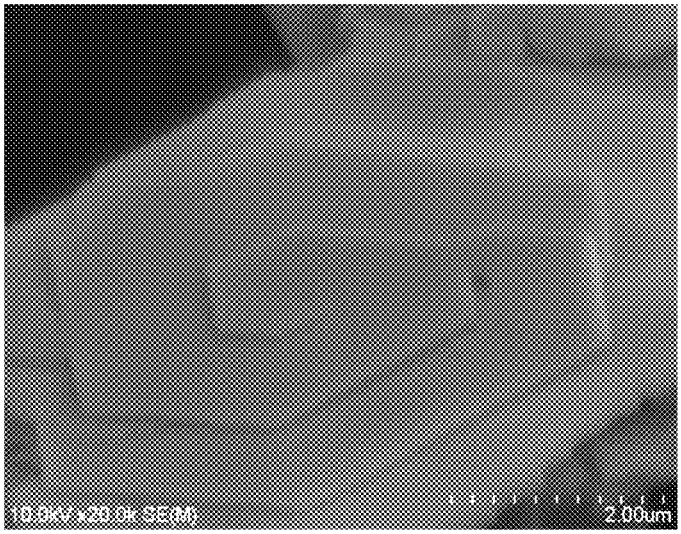
Figure 6C:
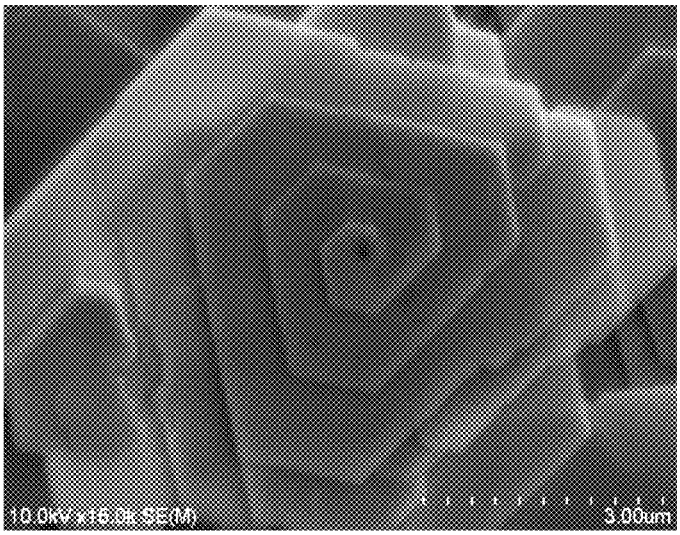
Figure 7A:
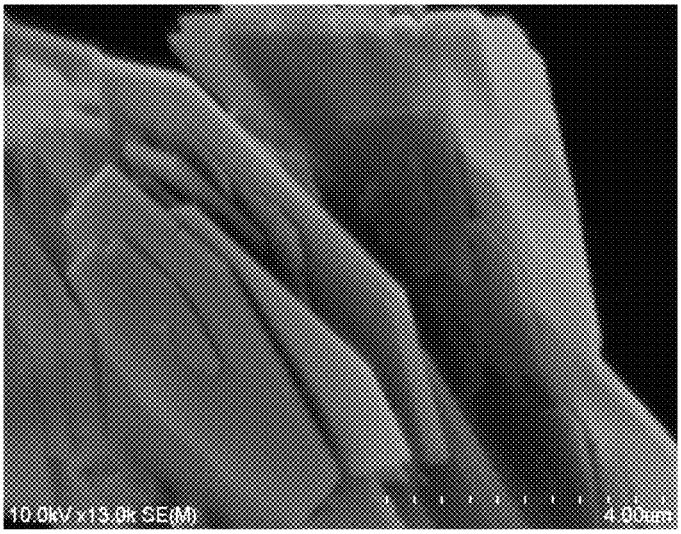
FIGS. 7A to 7C are micrographs showing a metal powder containing the fine layered metal particles as shown in FIG. 1.
Figure 7B:
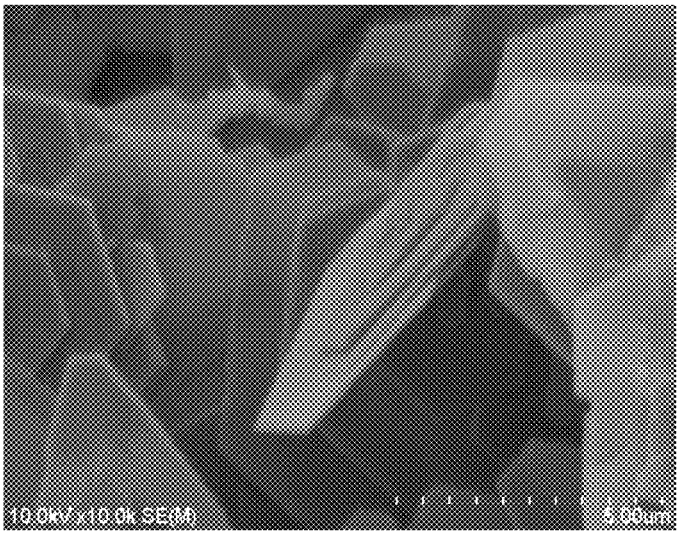
Figure 7C:
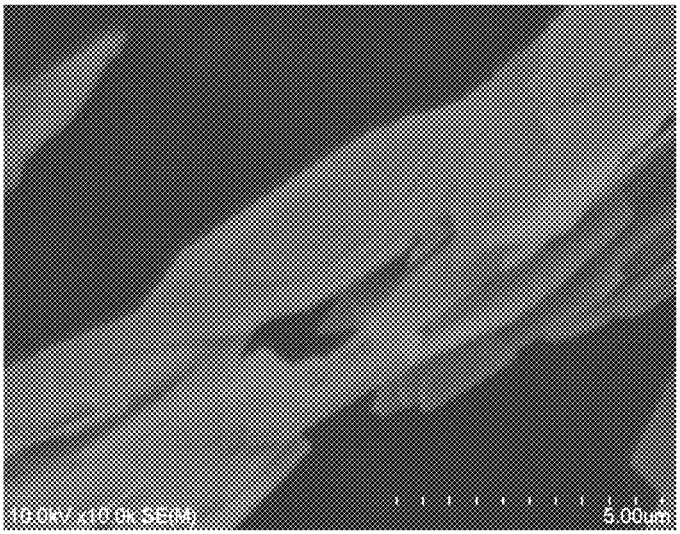
Figure 8A:
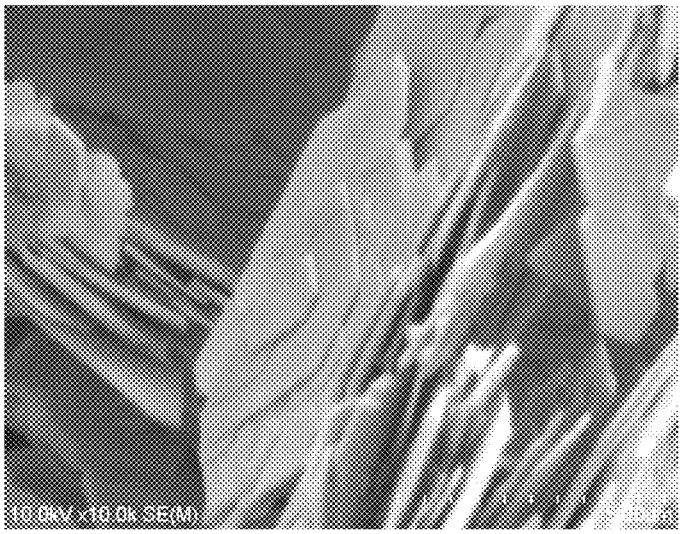
FIGS. 8A to 8C are micrographs showing a metal powder containing the fine layered metal particles as shown in FIG. 1.
Figure 8B:
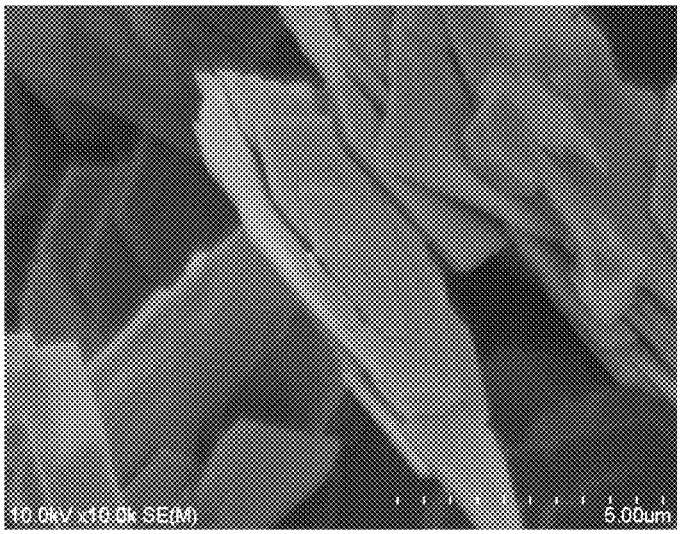
Figure 8C:
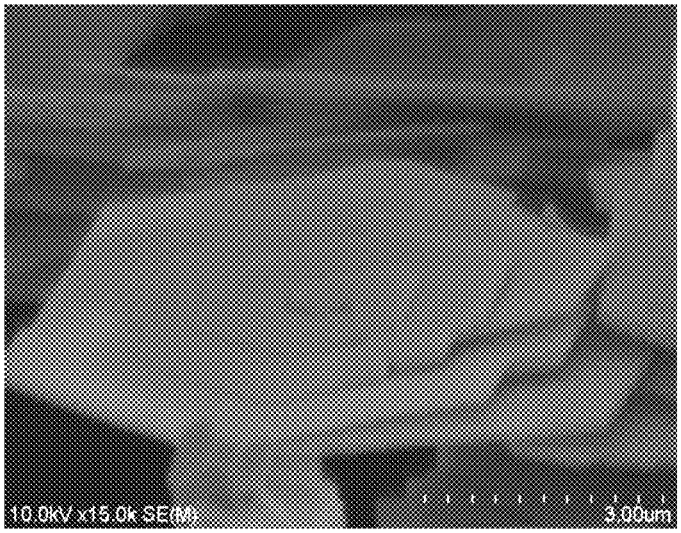

FIG. 4 is a schematic cross-sectional view of a pattern 14 obtained from an electrically-conductive paste containing the fine layered metal particles 2 as shown in FIGS. 1 to 3 and shows the pattern 14 together with a base 16. In FIG. 4, the arrow X represents the length direction of the pattern 14, and the arrow Y represents the thickness direction of the pattern 14. As shown in FIG. 4, the flake-shaped surface of each of the fine layered metal particles 2 is in contact with the flake-shaped surfaces of the adjacent fine layered metal particles 2. As the surfaces are in contact with one another, the area of contact between the fine layered metal particles 2 is large. Thus, electricity can flow easily between the fine layered metal particles 2. The electrical resistance of the paste in the length direction is low.

As shown in FIG. 4, the direction in which the layers of each of the fine layered metal particles 2 are stacked (the thickness direction of each of the fine layered metal particles 2) is substantially the same as the thickness direction of the paste. As previously stated, in each of the fine layered metal particles 2, each of the layers is integral with the other layers. Thus, the electrical resistance of the paste in the thickness direction is low.

For the paste, the electrical resistance in the length direction is low, and the electrical resistance in the thickness direction is also low. With the use of the fine layered metal particles 2 according to the present invention, a paste having high electrical conductivity can be obtained.

As previously stated, each of the fine layered metal particles 2 has spaces (S1 to S4) between the layers. The apparent density of the metal powder containing the fine layered metal particles 2 each of which has such spaces is low. As previously stated, each of the layers is integral with the other layers. Thus, the electrical resistance between the layers is low despite the presence of the spaces. The metal powder is light-weight and has low electrical resistance. A paste containing the metal powder can be obtained at low cost.

The fine layered metal particle 2 as shown in FIGS. 1 to 3 includes five layers. The number of the layers may be 4 or less or may be 6 or more. In the present invention, a fine metal particle including two or more flaky layers integral with each other is referred to as a "fine layered metal particle". The number of the layers is preferably 3 or more. The number of the layers is preferably 15 or less, more preferably 9 or less, and particularly preferably 5 or less.

The fine layered metal particle 2 as shown in FIGS. 1 to 3 includes layers other than the center layer 4, and the other layers are located both on and under the center layer 4. In the fine layered metal particle 2, a layer other than the center layer 4 may be located only on or under the center layer 4.

The metal powder may contain fine metal particles other than the fine layered metal particles 2. Examples of the fine metal particles other than the fine layered metal particles 2 include block-shaped particles, spherical particles, flaky particles, and polyhedral particles.

In view of the electrical conductivity, the proportion of the fine layered metal particles 2 in the fine metal particles is preferably 30 mass % or more, more preferably 50 mass % or more, and particularly preferably 60 mass % or more. The proportion is ideally 100 mass %.

The average particle diameter D50 of the metal powder is preferably from 0.1 to 30 μm. The use of the metal powder having an average particle diameter D50 of 0.1 μm or more can achieve a high filling ratio in printing. From this viewpoint, the average particle diameter D50 is more preferably 2.0 μm or more and particularly preferably 3.0 μm or more. The use of the metal powder having an average particle diameter D50 of 30 μm or less can result in a fine pattern 14. From this viewpoint, the average particle diameter D50 is more preferably 15 μm or less and particularly preferably 7 μm or less.

In view of the filling ratio, the minimum particle diameter Dmin is preferably 0.1 μm or more. In view of the fineness of the pattern 14, the maximum particle diameter D50max is preferably 30 μm or less.

The standard deviation σ of the particle diameters of the metal powder is preferably 15 μm or less. The use of the metal powder having a standard deviation σ of 15 μm or less can result in a homogeneous pattern 14. From this viewpoint, the standard deviation σ is more preferably 10 μm or less and particularly preferably 7 μm or less.

The average particle diameter D50, the minimum particle diameter Dmin, the maximum particle diameter D50max, and the standard deviation σ are measured by a laser diffraction particle size distribution analyzer. An example of the analyzer is "LA-950 V2" of HORIBA, Ltd.

Preferably, the metallographic structure of the fine layered metal particle 2 is monocrystalline. Such fine layered metal particles 2 can contribute to the electrical conductivity of a paste.

The fine layered metal particle 2 may include a metal and an organic compound attached to a surface of the metal. The organic compound is chemically bonded to the metal. The main component of the fine layered metal particle 2 is a metal. The proportion of the metal in the fine layered metal particle 2 is preferably 99.0 mass % or more and particularly preferably 99.5 mass % or more. The fine layered metal particle 2 may be free of any organic compound.

The following describes an example of the method of producing the metal powder. In the production method, a silver powder is obtained through a reduction process. The production method includes the steps of:

(1) preparing an aqueous solution of a silver salt;

(2) adding a reductant to the aqueous solution while stiffing the aqueous solution to precipitate flakes made of silver; and (3) further stirring the aqueous solution to allow the flakes to grow helically.

In the present invention, the flakes grow generally in the thickness direction (the upward/downward direction in FIG. 3). The outlines of the flakes rotate as the flakes grow. In the present invention, to grow in this manner is referred to as "grow helically". The helical growth of the flakes can result in silver particles (fine layered metal particles 2) each of which includes a plurality of stacked layers.

The silver salt in the aqueous solution prepared in the step (1) is preferably silver nitrate. The concentration of the silver salt in the aqueous solution is preferably from 0.1 to 1.0 M. The use of the aqueous solution having a concentration of 0.1 M or more can accelerate the growth of the particles. From this viewpoint, the concentration is more preferably 0.3 M or more and particularly preferably 0.4 M or more. The use of the aqueous solution having a concentration of 1.0 M or less increases the likelihood of precipitation of flaky layers. From this viewpoint, the concentration is more preferably 0.8 M or less and particularly preferably 0.7 M or less.

As the aqueous solution prepared in the step (1) contains an acid, the pH of the aqueous solution can be adjusted. In order to prevent aggregation of the particles during the crystal growth and thus increase the likelihood of precipitation of flaky layers, the pH is preferably 5 or less, more preferably 3 or less, and particularly preferably 2 or less. Examples of acids suitable for the pH adjustment include acetic acid, propionic acid, trifluoroacetic acid, hydrofluoric acid, nitric acid, hydrochloric acid, sulfuric acid, and phosphoric acid. Particularly preferred are hydrochloric acid, nitric acid, and sulfuric acid.

The aqueous solution prepared in the step (1) preferably contains a dispersant. A preferred dispersant is a glycol dispersant. The use of the aqueous solution containing a glycol dispersant can result in a silver powder in which the standard deviation σ of the particle diameters is small. A particularly preferred dispersant is polyethylene glycol.

Examples of the reductant added in the steps (2) and (3) include hydrazine, hydrazine compounds, formaldehyde, glucose, L-ascorbic acid, and D-erythorbic acid.

The rate of addition of the reductant has an impact on the formation of the fine layered metal particles 2. An extremely low rate of addition decreases the likelihood of precipitation of flak layers. An extremely high rate of addition decreases the likelihood of helical growth of the flakes. The rate is preferably such that the reductant is added in an amount necessary for reduction of 5 to 30 g of silver nitrate per second. The rate is particularly preferably such that the reductant is added in an amount necessary for reduction of 8 to 20 g of silver nitrate per second.

In the steps (2) and (3), the stirring speed is preferably from 100 to 500 rpm. In the steps (2) and (3), the temperature of the aqueous solution is preferably from 20 to 80° C. The time spent in the steps (2) and (3) (i.e., stirring time) is preferably from 10 to 60 minutes.

Means for obtaining the fine layered metal particles 2 includes:

(a) setting of the concentration of silver nitrate in the liquid dispersion to a specified range;

(b) use of a specified acid to set the pH of the aqueous silver nitrate solution to a specified range;

(c) use of a specified dispersant;
(d) addition of a specified reductant at a specified rate; and
(e) setting of the stirring speed to a specified range.

EXAMPLES

The following will show the effects of the present invention by means of examples. The present invention should not be construed in a limited manner on the basis of the description of the examples.

Example 1

Twenty cc of hydrazine was added to 0.5 liters of distilled water to obtain a reductant liquid. Fifty g of silver nitrate was added to 1 liter of distilled water, and 5 g of polyethylene glycol was further added to obtain an aqueous solution. Sulfuric acid was added to the aqueous solution until the pH of the aqueous solution reached 2. The reductant liquid was added to the aqueous solution at a rate of 100 cc/sec while the aqueous solution was stirred at a speed of 150 rpm. The stirring was further continued for 30 minutes while the temperature of the aqueous solution was maintained at 20° C. A silver powder containing fine layered metal particles was precipitated from the aqueous solution. FIGS. 5 to 8 show micrographs of the silver powder.

Examples 2 and 3

A silver powder of Example 2 was obtained in the same manner as in Example 1, except that 10 g of polyethylene glycol was added. A silver powder of Example 3 was obtained in the same manner as in Example 1, except that 20 g of polyethylene glycol was added.

Comparative Example 1

A silver powder containing fine flaky particles was obtained through a reaction in an autoclave. This silver powder production method is approximately the same as the production method as disclosed in WO 2016/125355.

Comparative Example 2

A silver powder of Comparative Example 2 was obtained in the same manner as in Example 1, except that the concentration of silver nitrate in the aqueous solution was 0.1 M, polyvinylpyrrolidone was used instead of polyethylene glycol, and the stirring speed was 300 rpm. The fine particles of the silver powder were spherical.

Comparative Example 3

A silver powder obtained by the method of Comparative Example 2 was processed by a bead mill to form the particles into flakes. Thus, a silver powder of Comparative Example 3 was obtained.

Electrical Conductivity Evaluation 1

Each of the silver powders was dispersed in methanol to obtain a paste. The silver concentration in the paste was 70 mass %. A glass slide was subjected to masking to make a surface to be coated with the paste. The surface had a size of 8 mm×50 mm. The paste was applied to the surface. The paste was held at 150° C. for 30 minutes to obtain a sintered material. The thickness of the sintered material was 10 μm. The specific electrical resistance of the sintered material was measured using a measurement device of Advanced Instrument Technology (Contact 4-Point Probe). The results are shown in Table 1 below.

Electrical Conductivity Evaluation 2

The specific electrical resistance was measured in the same manner as in Evaluation 1, except that the sintering temperature was 130° C. The results are shown in Table 1 below.

TABLE 1

Evaluation Results

| | Example 1 | Example 2 | Example 3 | Comp. Example 1 | Comp. Example 2 | Comp. Example 3 |
|---|---|---|---|---|---|---|
| Production Shape | Reduction Flake Layered | Reduction Flake Layered | Reduction Flake Layered | Autoclave Flake | Reduction Sphere | Mill Flake |
| D50 (μm) | 4.7 | 11.5 | 25.1 | 4.6 | 1.1 | 4.6 |
| σ (μm) | 1.5 | 3.2 | 10.7 | 2.2 | 0.3 | 4.2 |
| Specific electrical resistance (μΩ • cm) | | | | | | |
| 150° C. × 30 min | 61 | 70 | 83 | 145 | 319 | 213 |
| 130° C. × 30 min | 78 | 82 | 89 | — | — | — |

As seen from table 1, the sintered materials obtained from the silver powders of Examples had high electrical conductivity. The evaluation results demonstrate the superiority of the present invention.

INDUSTRIAL APPLICABILITY

The metal powder according to the present invention can be used in various pastes such as a paste for a printed circuit board, a paste for an electromagnetic shielding film, a paste for an electrically-conductive adhesive, and a paste for die bonding.

REFERENCE SIGNS LIST

2 fine layered metal particle
4 center layer
6 upper middle layer
8 upper end layer

10 lower middle layer
12 lower end layer
14 pattern
16 base

The invention claimed is:

1. A fine layered metal particle comprising:
a first layer shaped as a flake; and
a second layer shaped as a flake, located on the first layer, which belongs to the same crystal with the first layer.

2. The fine layered metal particle according to claim 1, wherein the second layer is partially spaced away from the first layer.

3. The fine layered metal particle according to claim 1, wherein a material of the fine layered metal particle is an electrically-conductive metal.

4. The fine layered metal particle according to claim 3, wherein the electrically-conductive metal is silver or copper.

5. The fine layered metal particle according to claim 1, wherein the first layer and the second layer are formed by helical growth of the layers.

6. A metal powder comprising fine metal particles, wherein
the fine metal particles include fine layered metal particles, and
each of the fine layered metal particles includes
a first layer shaped as a flake, and
a second layer shaped as a flake, located on the first layer, which belongs to the same crystal with the first layer.

7. The metal powder according to claim 6, wherein the second layer is partially spaced from the first layer.

8. The metal powder according to claim 6, wherein a material of the metal powder is an electrically-conductive metal.

9. The metal powder according to claim 8, wherein the electrically-conductive metal is silver or copper.

10. The metal powder according to claim 6, wherein a proportion of the fine layered metal particles in the fine metal particles is 30 mass % or more.

11. The metal powder according to claim 6, wherein an average particle diameter of the metal powder is from 0.1 to 30 μm.

12. The metal powder according to claim 6, wherein a standard deviation of particle diameters of the metal powder is 15 μm or less.

13. The metal powder according to claim 6, wherein the first layer and the second layer are formed by helical growth of the layers.

* * * * *